US010953339B1

(12) United States Patent
Liu

(10) Patent No.: US 10,953,339 B1
(45) Date of Patent: Mar. 23, 2021

(54) MAGNETIC CUBE ROLLER COASTER

(71) Applicant: Xianming Liu, Foshan (CN)

(72) Inventor: Xianming Liu, Foshan (CN)

( * ) Notice: Subject to any disclaimer, the term of this patent is extended or adjusted under 35 U.S.C. 154(b) by 0 days.

(21) Appl. No.: 16/929,483

(22) Filed: Jul. 15, 2020

(51) Int. Cl.

| | |
|---|---|
| ***A63H 33/04*** | (2006.01) |
| ***A63H 18/02*** | (2006.01) |
| ***A63H 33/26*** | (2006.01) |
| *A63H 18/14* | (2006.01) |

(52) U.S. Cl.
CPC ..... *A63H 33/046* (2013.01); *A63H 18/02* (2013.01); *A63H 33/26* (2013.01); *A63H 18/14* (2013.01)

(58) Field of Classification Search
CPC ..... A63H 33/04; A63H 33/046; A63H 33/26; A63H 18/00; A63H 18/02; A63H 18/06; A63H 18/14
See application file for complete search history.

(56) References Cited

U.S. PATENT DOCUMENTS 5,456,410 A * 10/1995 Chow ..... A63H 18/02 104/125
5,709,581 A * 1/1998 Rothbarth ..... A63F 7/3622 446/171
7,154,363 B2 * 12/2006 Hunts ..... H01F 7/0242 335/306
8,911,276 B2 * 12/2014 Kim ..... A63H 33/046 446/92
9,956,493 B1 * 5/2018 Hunts, Jr. ..... A63H 33/046
2006/0099375 A1 * 5/2006 Lee ..... A63H 33/22 428/53
2012/0322339 A1 * 12/2012 Kim ..... A63H 33/046 446/92
2018/0104611 A1 * 4/2018 Gabra ..... A63H 33/084
2019/0001231 A1 * 1/2019 Schmick ..... G09B 15/00

* cited by examiner

*Primary Examiner* — Eugene L Kim
*Assistant Examiner* — Alyssa M Hylinski
(74) *Attorney, Agent, or Firm* — Rumit Ranjit Kanakia

(57) ABSTRACT

A cube body comprising four U-shaped frames, each of the four U-shaped frames has two rectangular corners and two open ends, wherein a first connection is arranged at each of the two rectangular corners and perpendicular to the two open ends, the two open ends are provided with a second connection which is insertable into the first connection of another one of the four U-shaped frames, each of the two rectangular corners has a first magnetic bead inside, a first engaging structure is arranged on each inner side of each of the four U-shaped frames. A magnetic cube roller coaster comprising the said cube body and a magnetic plain plate is also provided.

8 Claims, 15 Drawing Sheets

MAGNETIC CUBE ROLLER COASTER

TECHNICAL FIELD

The present application relates to the technical field of toy products, and in particular to a magnetic cube roller coaster.

BACKGROUND

With the development of scientific technology, educational toys are becoming more and more popular with consumers, particularly building blocks and track toys.

The track toy in the prior art generally includes a track and a bracket, which is installed under the track to support the track. When using, a ball or other sliding device falls from one end of the track, and the ball will move along the track all the way. However, the number of brackets in the prior art is limited, which results in that the overall shape of the track toy is single, the user cannot change the shape of the track toy according to his own ideas, and the fun of the toy is reduced.

The building blocks have various shapes. The U.S. Pat. No. 6,050,873 discloses toy building blocks. Building blocks are generally assembled with several building blocks of different shapes into a whole by concave-convex splicing, so as to present a certain shape. However, the disadvantage of building blocks is that the splicing place is often designed to be very compact, so that users, especially children, will feel it laborious to splice the building blocks and disassemble the assembled blocks.

SUMMARY

The purpose of the present application is to provide a magnetic cube roller coaster, which aims to overcome the defect that the track toy in the prior art cannot be constructed in various shapes.

One embodiment of the present application provides a magnetic cube, comprising a cube body with hollow structure, wherein the cube body comprises four U-shaped frames, each of the four U-shaped frames has two rectangular corners and two open ends, wherein a first connection is arranged at each of the two rectangular corners and perpendicular to the two open ends, the two open ends are provided with a second connection which is insertable into the first connection of another one of the four U-shaped frames, each of the two rectangular corners has a first magnetic bead inside, a first engaging structure is arranged on each inner side of each of the four U-shaped frames.

Further, the first engaging structure has a first slot and two first protrusions, the first slot is arranged between the two first protrusions.

Further, the magnetic cube further comprises a fixing clip, which is clamped with two neighboring magnetic cubes simultaneously.

Another embodiment of the present application provides a magnetic plain plate, comprising a square plain plate body with 4 corners and four second magnetic beads arranged therein, the square plain plate body has a hollow structure, the square plain plate body has four inner sides and each inner side has a second engaging structure.

Further, the second engaging structure has a first slot and two first protrusions, the first slot is arranged between the two first protrusions.

Another embodiment of the present application provides a magnetic cube roller coaster, comprising a track, a steel ball and the magnetic cube above, the track is fixed with the first engaging structure of the magnetic cube in a snap-fit manner, the track comprises a plurality of track components with different shapes, wherein each of the track components comprises a contact surface and a connector located below the contact surface and integrally formed with the contact surface.

Further, the track comprises a horizontal forward straight track component, a horizontal 180-degree turn track component, a down forward track component and a horizontal 90-degree turn track component.

Further, the magnetic cube roller coaster further comprises the above-mentioned magnetic plain plate, the magnetic plain plate and the magnetic cube are combined into different shapes through magnetic splicing.

Further, the track is fixed with the second engaging structure of the magnetic plain plate in a snap-fit manner, and the second engaging structure has a same structure with the first engaging structure.

Further, the track further comprises a loop track component, a down-extender inclined straight track component, a bottom-hill track component, a top-hill track component and a down-turn track component.

Further, the magnetic cube roller coaster further comprises a magnetic launcher for preventing the steel ball from moving forward, the magnetic launcher has a structure with a cross section of "I" shape, the magnetic launcher is fixed in the magnetic cube or on the magnetic plain plate in a snap-fit manner.

Compared with the prior art, the embodiments of the present application have the following beneficial effects: the connector of the track is installed in the first slot of the magnetic cube or the third slot of the magnetic plain plate in a snap-fit manner, so that the track can fixed in the magnetic cube or on the magnetic plain plate in a snap-fit manner. The magnetic cube and the magnetic cube, the magnetic cube and the magnetic plain plate, the magnetic plain plate and the magnetic plain plate can be arbitrarily spliced through the magnetism, and the track comprises a plurality of track components of different shapes, which enables the shape of the track can be constructed according to the user's idea. And through the combination mode of magnetic splicing, it does not need users to use too much force to assemble and disassemble the magnetic cube. The fixing clip can also be used to reinforce the magnetic cubes, so that the splicing between the magnetic cubes is more compact.

BRIEF DESCRIPTION OF THE DRAWINGS

In order to more clearly illustrate the technical solutions in the embodiments of the present application, drawings used in the description of the embodiments will be briefly described below, obviously, the drawings in the following description are some embodiments of the present application, those of ordinary skill in the art can also obtain other drawings based on these drawings without any creative efforts.

DESCRIPTION OF THE EMBODIMENTS

The present application will be further described in combination with specific embodiments and drawings.

The terms, such as "first", "second", "third", "fourth", etc., in the specification, claims and the accompanying drawings of the present application are used to distinguish different objects, and are not intended to describe a specific order. Furthermore, the terms "comprise", "have" and any variations thereof are intended to cover a non-exclusive inclusion. For example, a process, method, system, product, or device that comprises a series of steps or units is not limited to the listed steps or units, but alternatively comprises steps or units that are not listed, or alternatively comprises other steps or units inherent to these processes, methods, products or devices.

References to "an embodiment" herein mean that a particular feature, structure, or characteristic described in connection with the embodiments can be included in at least one embodiment of the present application. The appearances of the phrase in various places in the specification are not necessarily referring to the same embodiments, and are not exclusive or alternative embodiments that are mutually exclusive from other embodiments. Those skilled in the art will explicitly and implicitly understand that the embodiments described herein can be combined with other embodiments.

The First Embodiment

Figure 1:
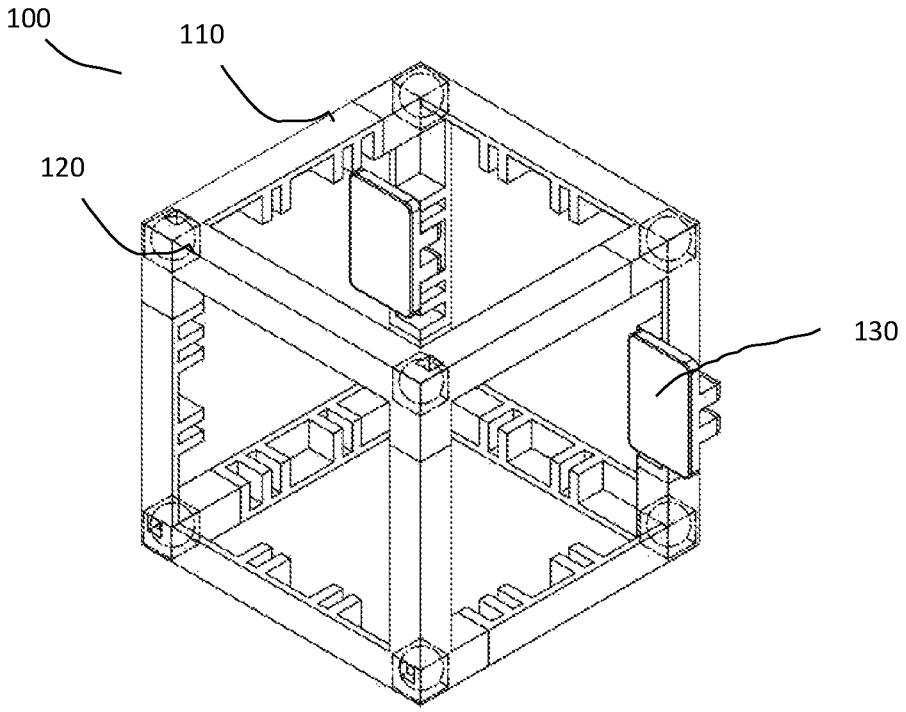
FIG. 1 is a perspective view of a magnetic cube provided by the first embodiment of the present application.
Figure 2:
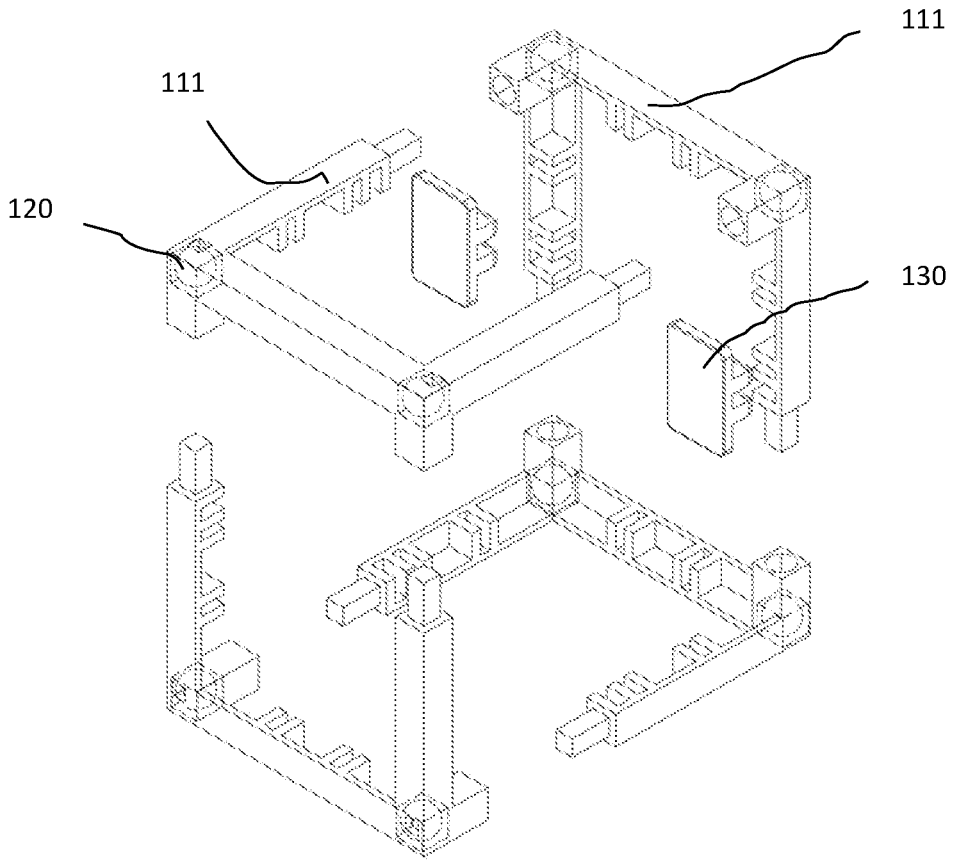
FIG. 2 is an exploded perspective view of the magnetic cube provided by the first embodiment of the present application.

Referring to FIGS. 1 and 2, FIG. 1 shows a perspective view of a magnetic cube, FIG. 2 is an exploded perspective view of the magnetic cube. The embodiment of the present application provides a magnetic cube 100, which comprises a cube body 110 with hollow structure and a plurality of first magnetic beads 120.

Figure 3:
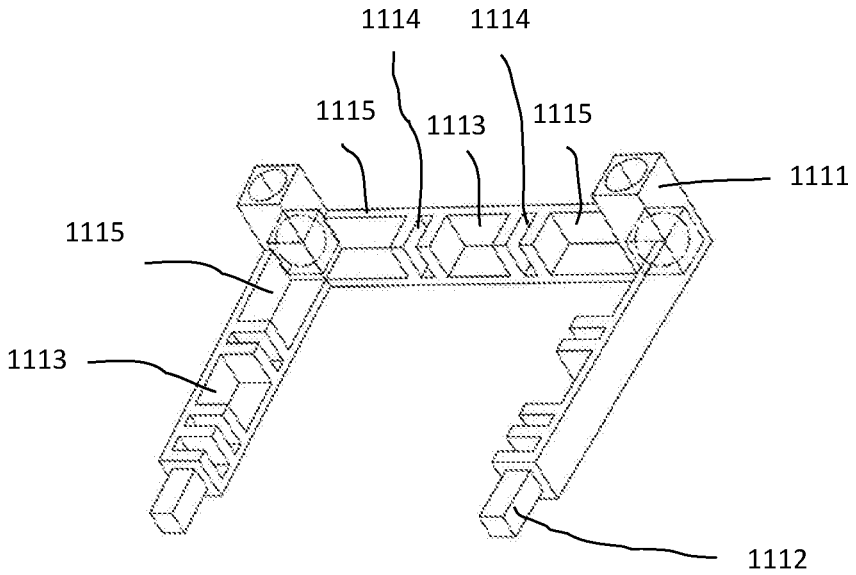
FIG. 3 is a perspective view of a U-shaped frame of the magnetic cube provided by the first embodiment of the present application.

The cube body 110 comprises four U-shaped frames 111. FIG. 3 is a perspective view of a U-shaped frame of the magnetic cube, as shown in FIG. 3, each of the four U-shaped frames 111 has two rectangular corners and two open ends. The first connection (a plughole) 1111 is arranged outside each of the two rectangular corners and perpendicular to the two open ends, the two open ends are provided with the second connection (a post) 1112, which is insertable into the first connection 1111 of another one of the four U-shaped frames. The cube body 110 is assembled by inserting the second connection 1112 of one U-shaped frame into the first connection 1111 of another U-shaped frame. The cube body 110 has a cubic structure. Preferably, the post has a square section.

The interior of each corner comprises a small cube space, and the plurality of the first magnetic beads 120 are placed in small cube spaces of the four U-shaped frames 111. Alternatively, 8 first magnetic beads 120 are provided, that is, each of the 8 top corners of the cube body 110 is provided with one first magnetic bead 120.

When two magnetic cubes 100 are close to each other, the magnetic attraction between the first magnetic beads 120 splices the two magnetic cubes 100 together, that is, the splicing mode of the magnetic cubes is through magnetism. This splicing mode is very simple and convenient, and the cubes can be spliced arbitrarily. For children, it is very labor-saving to assemble and disassemble the cubes, and it is easy to splice out of a variety of shapes, which increases the fun of playing with toys.

Alternatively, the cube body 110 is made of PVC material, PE material or ABS material, preferably ABS material. ABS material is non-toxic and harmless, it is resistant to high temperature, low temperature, corrosion resistance and wear.

Alternatively, the cube body 110 may be transparent or opaque, preferably transparent.

Alternatively, the cube body 110 may be of different colors, comprising red, green, blue, orange, yellow, cyan, purple, black and white.

Further, referring to FIG. 3, each inner side of each of the U-shaped frames 111 are provided with the first engaging structure, which has the first slot 1113 and two first protrusions 1114. The first engaging structure is arranged at the middle position of each inner side of each of the U-shaped frames 111, and the first slot 1113 is arranged between the two first protrusions 1114, wherein the width and height of the first slot 1113 are the same as those of the two first protrusions 1114.

Alternatively, on each side of the U-shaped frame 111, the second slot 1115 is provided between the first protrusion of the two first protrusions 1114 close to the corner and the corner. Specifically, one second slot 1115 is arranged on each of the two sides of the U-shaped frame 111 where the two open ends are located, and two second slots 1115 are arranged on the side of the U-shaped frame 111 connecting the two corners. The weight of the magnetic cube 100 can be reduced by setting the second slot 1115.

Figure 4:
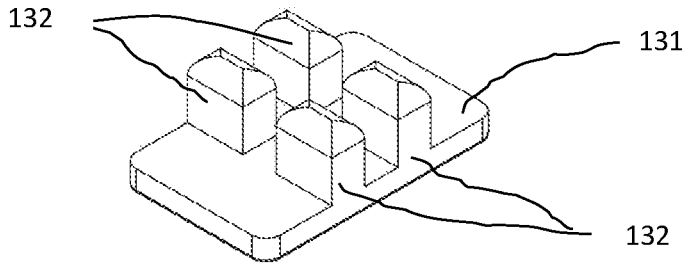
FIG. 4 is a perspective view of a fixing clip of the magnetic cube provided by the first embodiment of the present application.

FIG. 4 is a perspective view of a fixing clip of the magnetic cube. As shown in FIGS. 1, 2 and 4, the magnetic cube 100 further comprises a fixing clip 130, which comprises a flat plate 131 and two plug slots 132, wherein each of the two plug slots 132 can be stuck in the first slot 1113 and the two plug slots 132 form a groove, which enables the fixing clip 130 to be clamped with two neighboring magnetic cubes 100 simultaneously, so as to realize the reinforcement of the magnetic splice of the magnetic cubes and effectively prevents the relative sliding between the magnetic cubes under the magnetic splicing mode.

Therefore, the magnetic cubes provided in the present application are spliced through magnetism, and different shapes can be realized by splicing the magnetic cubes arbitrarily. In addition, the magnetic cubes can also be reinforced by fixing clips, so that the magnetic cubes in a row can be reinforced into a whole, that is, the advantages of the traditional building blocks are retained and the splicing between the magnetic cubes is more compact.

Figure 5:
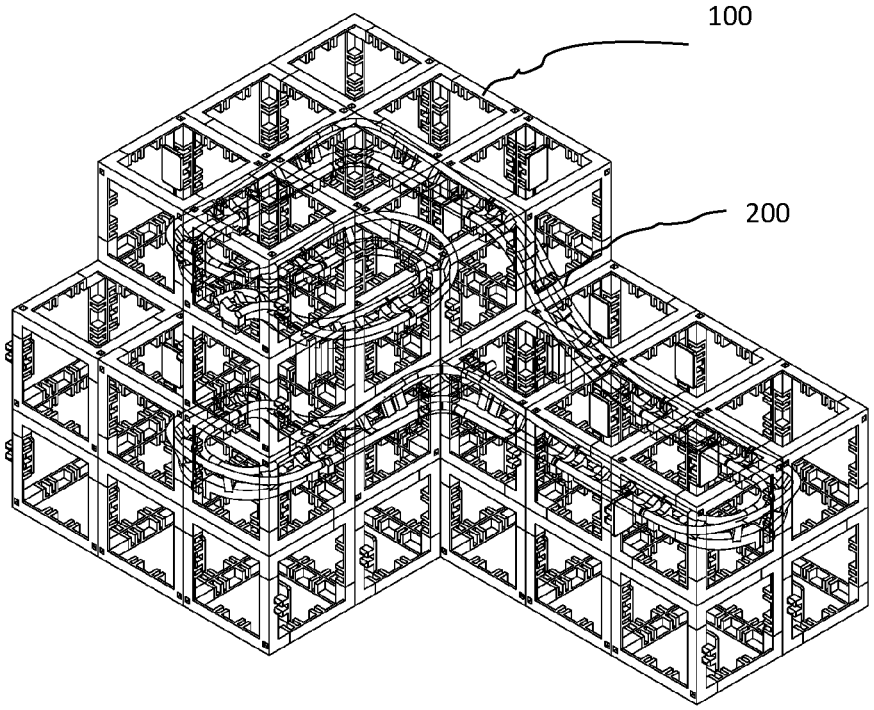
FIG. 5 is a perspective view of a magnetic cube roller coaster provided by the first embodiment of the present application.
Figure 6:
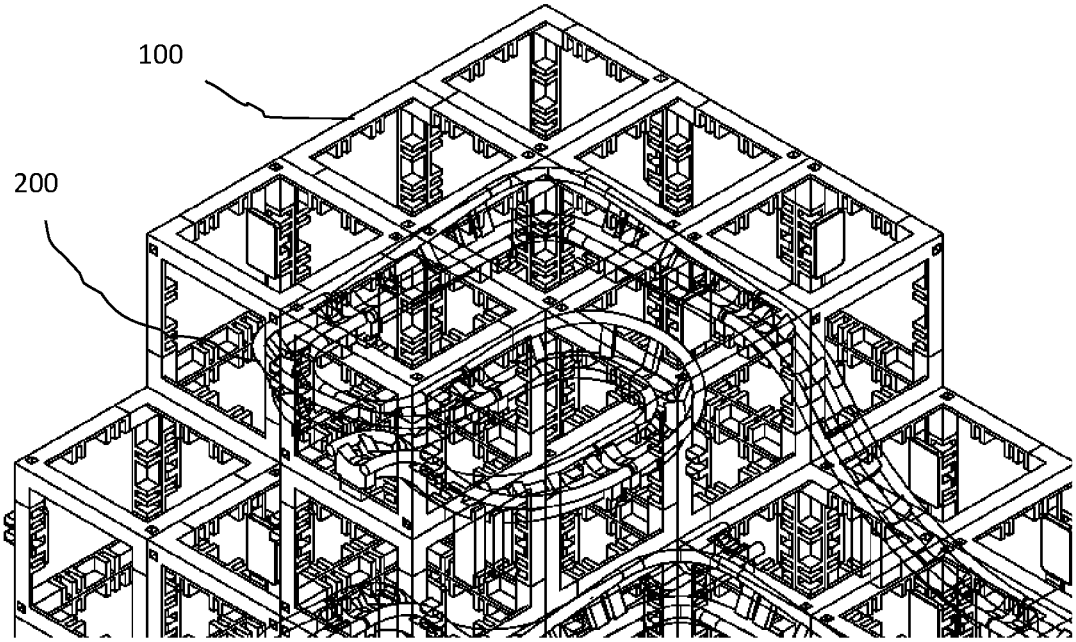
FIG. 6 is a partial enlarged view of the magnetic cube roller coaster shown in FIG. 5.
Figure 7:
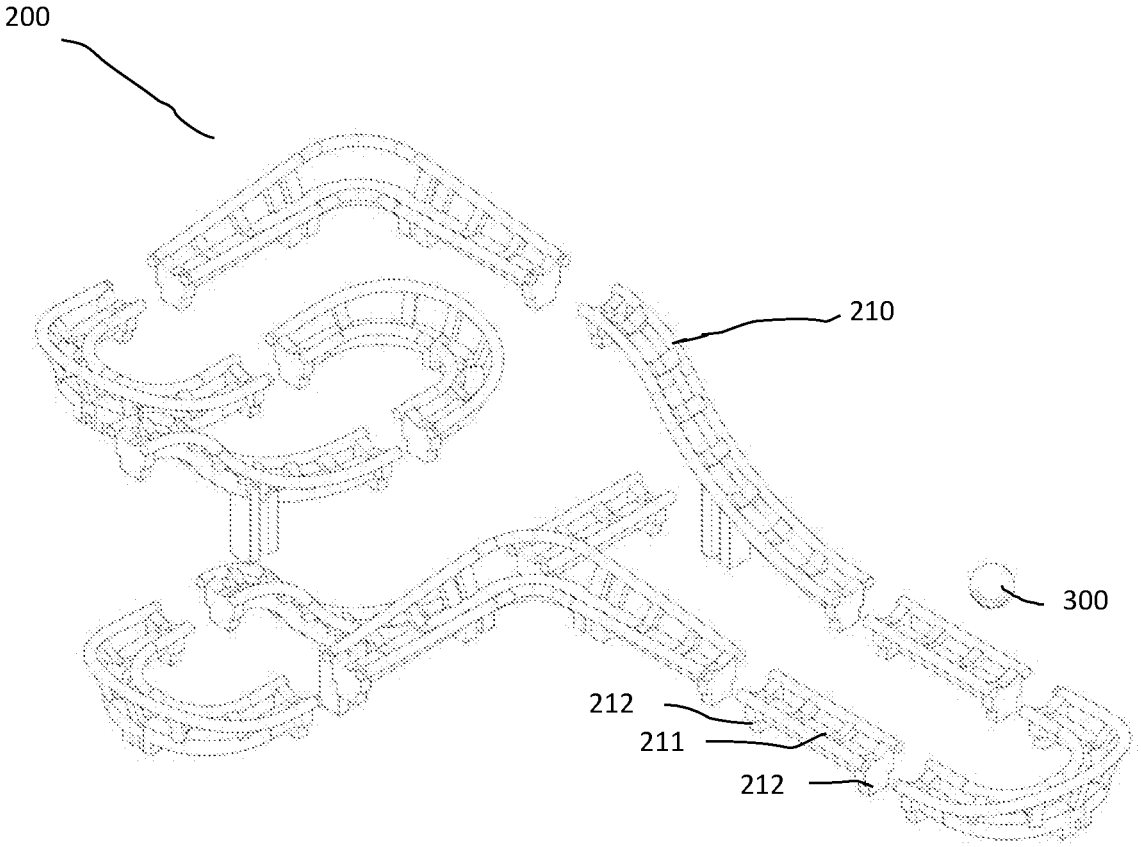
FIG. 7 is an exploded perspective view of a track of the magnetic cube roller coaster shown in FIG. 5.
Figure 8:
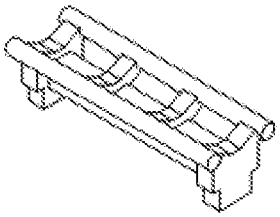
FIG. 8 is a perspective view of a horizontal forward straight track component provided by the first embodiment of the present application.

Referring to FIGS. 5 to 7, FIG. 5 is a perspective view of a magnetic cube roller coaster, FIG. 6 is a partial enlarged view of the magnetic cube roller coaster shown in FIG. 5, and FIG. 7 is an explored perspective view of a track of the magnetic cube roller coaster shown in FIG. 5. The embodiment of the present application provides a magnetic cube roller coaster, which comprises a plurality of magnetic cubes 100, a track 200 and a steel ball 300. The track 200 is installed in the first slots 1113 in a snap-fit manner, so that the track 200 can be fixed in the magnetic cubes 100 in a snap-fit manner. That is, the combination mode of the track and the magnetic cube is snap connection.

Alternatively, the steel ball 300 can also be replaced by a glass ball.

When in use, the steel ball 300 is lowered from the starting point of the track 200, and the steel ball 300 rolls on the track 200 along the track 200. Since the track is fixed in the magnetic cubes in a snap-fit manner, the height of each part of the track is changeable through the deformation of the magnetic cubes, so as to provide the required heights for the track to dive down and move up, so that the steel ball 300 can roll from the starting point of the track to the end of the track without getting stuck somewhere. Therefore, the magnetic cube roller coaster provided by the present application can ensure the steel ball to roll continuously along the track and go through a complete track without providing the supporting part of the traditional track toy, and without providing additional power drive device.

As shown in FIG. 7, the track 200 comprises a plurality of track components 210 with different shapes. The track component 210 comprises a contact surface 211 on which the steel ball 300 rolls, and a connector 212 located below the contact surface 211 and integrally formed with the contact surface 211. The connector 212 is matched with the first slot 1113 of the first engaging structure, the connector 212 is installed in the first slot 1113 in a snap-fit manner, so that the track 200 can be fixed with the first engaging structure of the magnetic cube 100 in a snap-fit manner. The contact surfaces 211 of the track components 210 with different shapes can be seamlessly joined, so that each track component 210 fixed in the magnetic cube 100 in a snap-fit manner can be spliced into a complete track 200.

Figure 9:
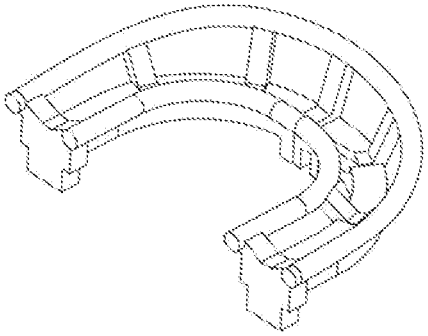
FIG. 9 is a perspective view of a horizontal 180-degree turn track component provided by the first embodiment of the present application.
Figure 10:
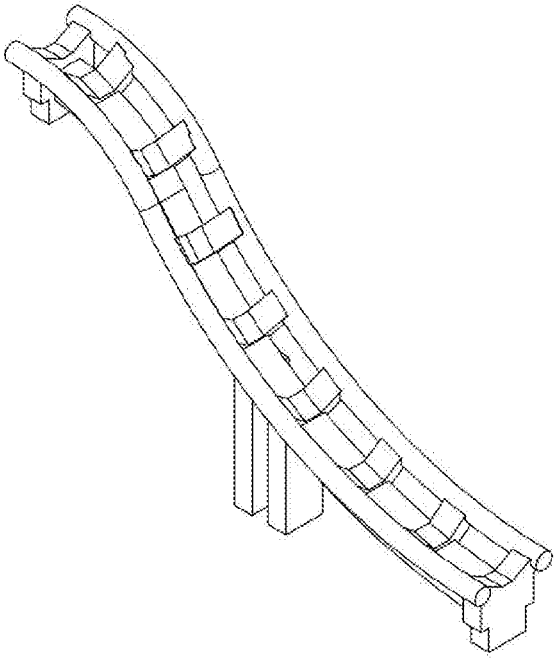
FIG. 10 is a perspective view of a down forward track component provided by the first embodiment of the present application.
Figure 11:
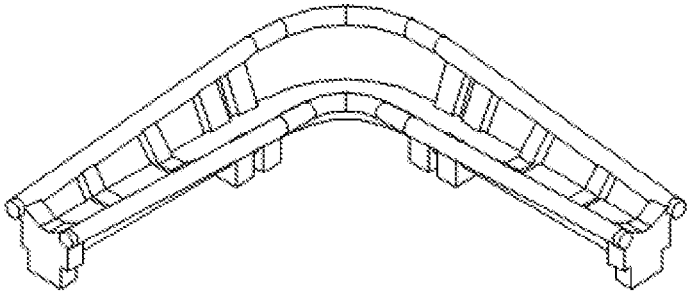
FIG. 11 is a perspective view of a horizontal 90-degree turn track component provided by the first embodiment of the present application.

Referring to FIGS. 8 to 11, FIG. 8 is a perspective view of a horizontal forward straight track component, FIG. 9 is a perspective view of a horizontal 180-degree turn (or U-shaped turn) track component, FIG. 10 is a perspective view of a down forward track component, and FIG. 11 is a perspective view of a horizontal 90-degree turn (or Quarter-turn) track component. As shown in FIGS. 8 to 11, the track 200 comprises a horizontal forward straight track component, a horizontal 180-degree turn track component, a down forward track component and a horizontal 90-degree turn track component.

Alternatively, the track 200 is made of PVC material, PE material or ABS material, preferably ABS material.

Alternatively, the track 200 may be transparent or opaque, preferably transparent.

Alternatively, the track 200 may be of different colors, comprising red, green, blue, orange, yellow, cyan, purple, black and white, preferably red.

Figure 12:
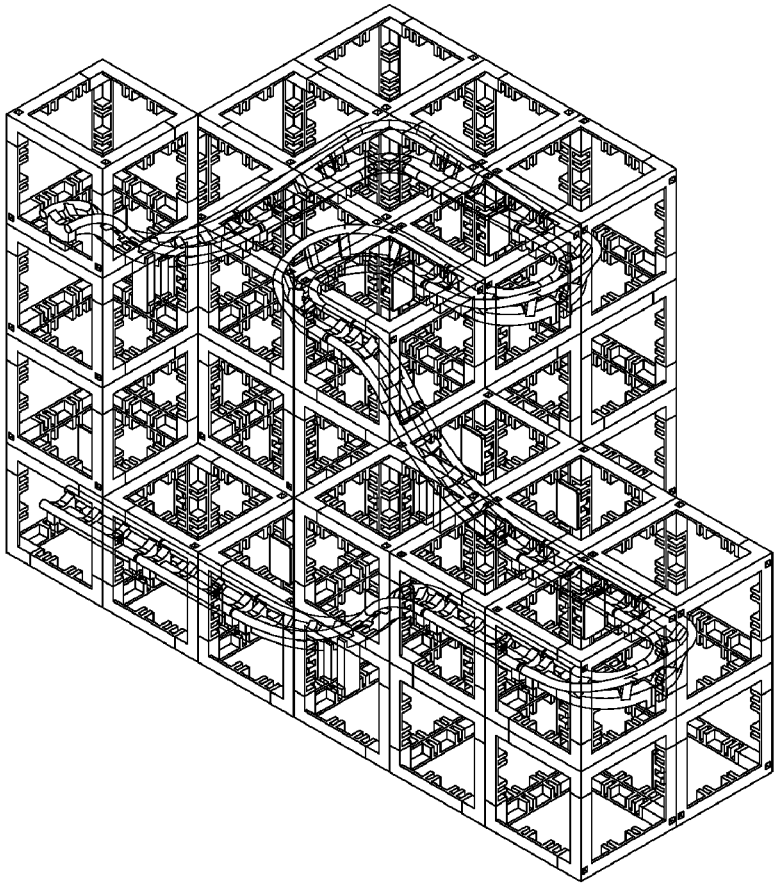
FIG. 12 is a perspective view of another magnetic cube roller coaster provided by the first embodiment of the present application.
Figure 13:
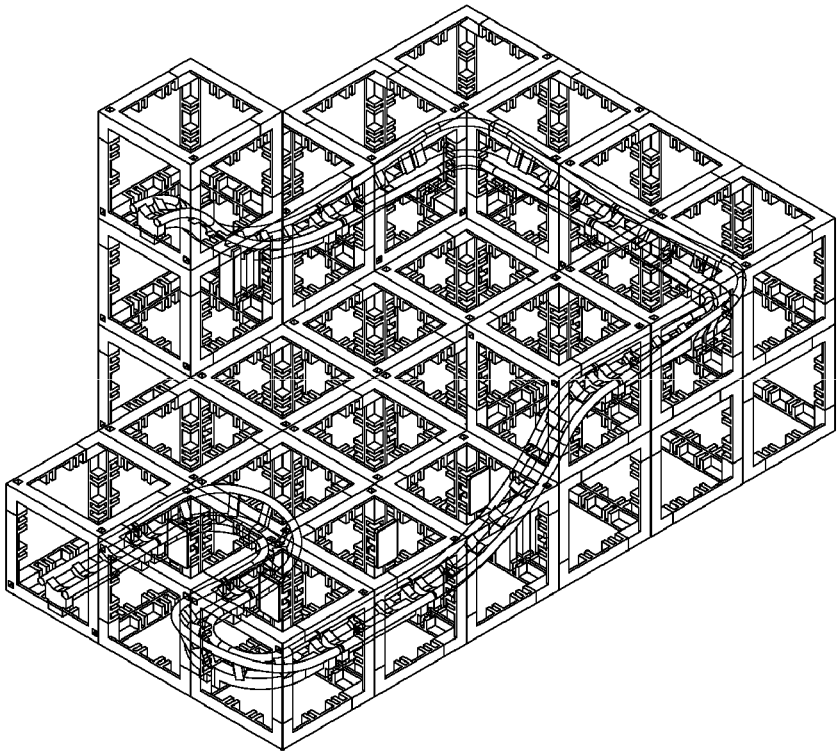
FIG. 13 is a perspective view of another magnetic cube roller coaster provided by the first embodiment of the present application.
Figure 14:
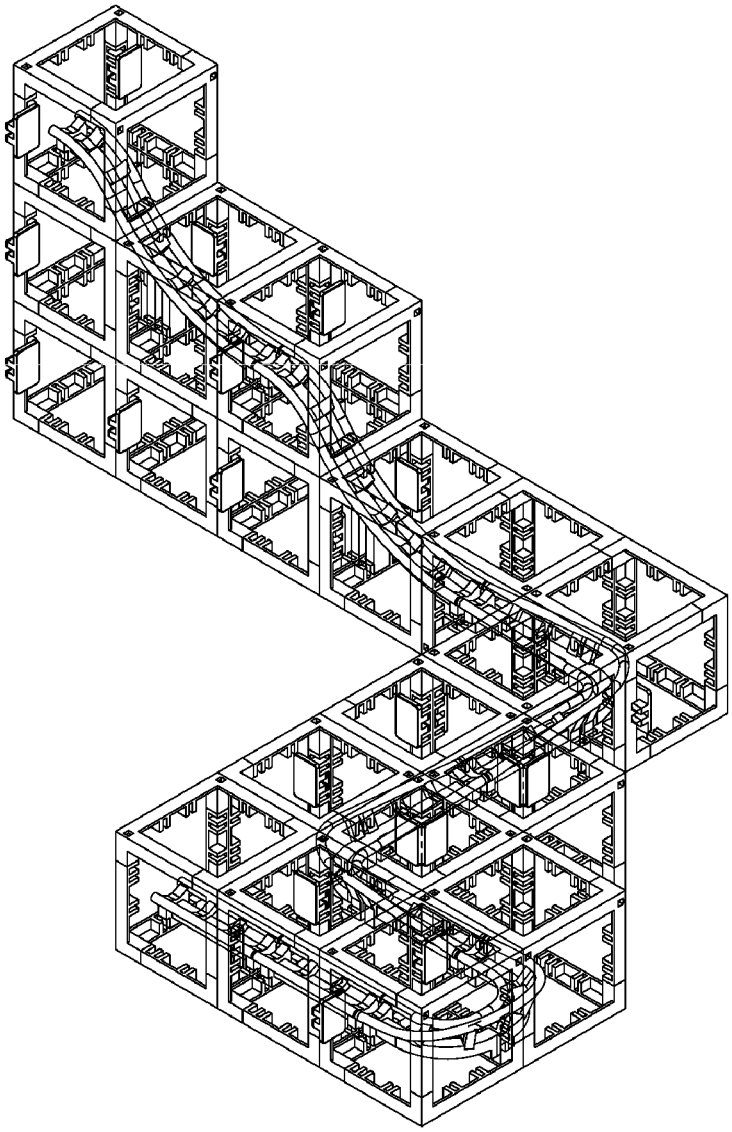
FIG. 14 is a perspective view of another magnetic cube roller coaster provided by the first embodiment of the present application.

Referring to FIGS. 12 to 14, FIGS. 12 to 14 show other magnetic cube roller coasters with different track directions. It can be seen that the direction of any track, whether it is forward, 90-degree turn, 180-degree turn or down, can be realized through the splicing of the magnetic cubes. Moreover, because the magnetic cubes are spliced with each other through magnetism and the track is fixed in the magnetic cubes in a snap-fit manner, the track can be extended by splicing the magnetic cubes. The track can be constructed with different shapes and can realize various creativity of users.

By combining traditional building blocks and roller coaster track, the magnetic cube roller coaster provided by the present application solves the problem that traditional building blocks are relatively laborious to assemble and disassemble due to too compact splicing. By fixing the roller coaster track in the magnetic cube in a snap-fit manner, the magnetic cube roller coaster provided by the present application also solves the problem of too few changes in shape of the traditional roller coaster track toy due to the limited number of supporting parts.

The magnetic cube roller coaster provided by the present application not only retains the variability of traditional building blocks, that is, the magnetic cubes can be spliced arbitrarily, but also the shape of the roller coaster track can be arbitrarily constructed according to the user's ideas. The magnetic cube roller coaster is very interesting, which can bring more fun to children through self-assembly. It also has the educational function, which can cultivate children's concentration, improve their hands-on ability and spatial imagination ability. And by means of magnetic splicing, the user can complete the assembly and disassembly of the magnetic cubes without using too much effort. The magnetic cubes can also be reinforced by using a fixing clip, thereby making the splicing between the magnetic cubes more compact.

The Second Embodiment

Figure 15:
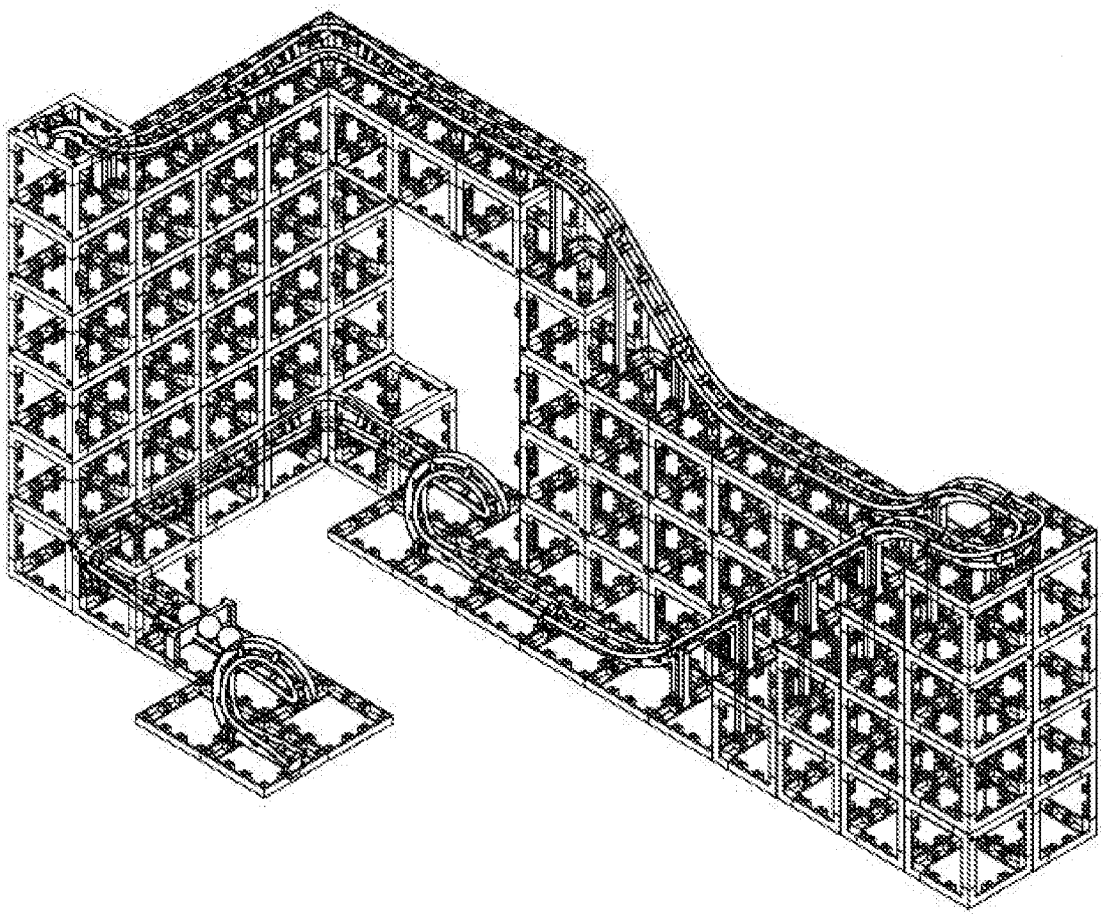
FIG. 15 is a perspective view of a magnetic cube roller coaster provided by the second embodiment of the present application.
Figure 16:
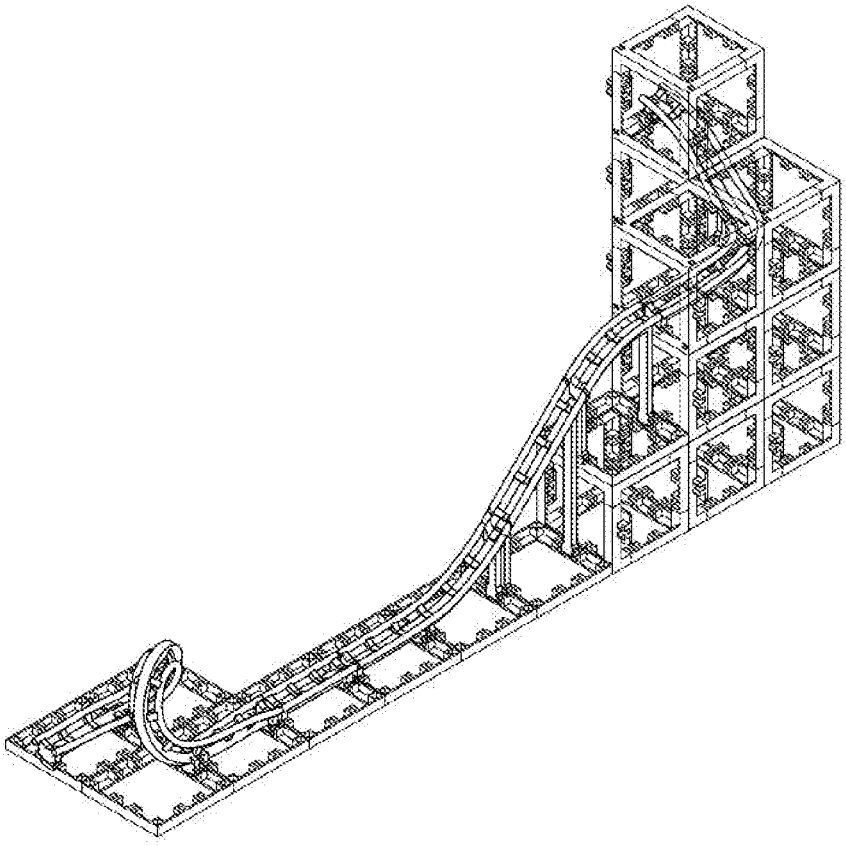
FIG. 16 is a perspective view of another magnetic cube roller coaster provided by the second embodiment of the present application.

Referring to FIGS. 15 and 16, FIG. 15 is a perspective view of a magnetic cube roller coaster, and FIG. 16 is a perspective view of another magnetic cube roller coaster. The difference from the first embodiment is that the magnetic cube roller coaster provided in the second embodiment further comprises a plurality of magnetic plain plates 400, the magnetic plain plates 400 and the magnetic cubes 100 can be arbitrarily combined into different shapes through magnetic splicing, the track 200 can be fixed on the magnetic plain plates 400 in a snap-fit manner, and the combination mode of the track 200 and the magnetic plain plate 400 is snap connection.

Figure 17:
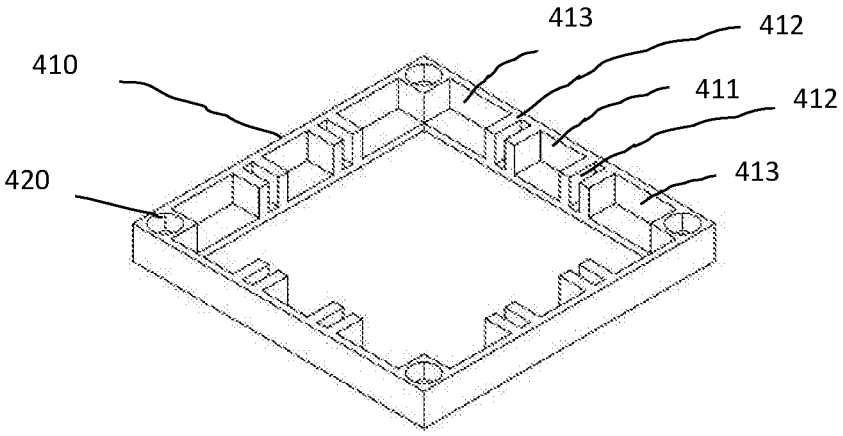
FIG. 17 is a perspective view of a magnetic plain plate provided by the second embodiment of the present application.
Figure 18:
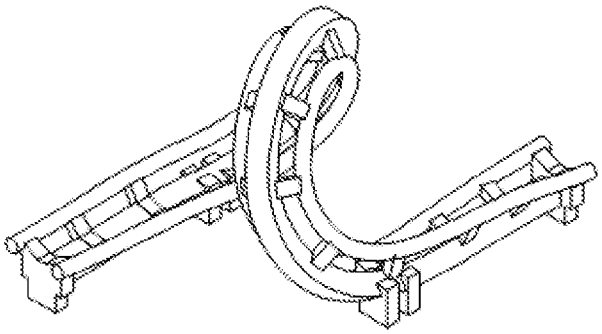
FIG. 18 is a perspective view of a loop track component provided by the second embodiment of the present application.

Referring to FIG. 17, FIG. 17 is a perspective view of a magnetic plain plate. The second embodiment of the present application provides a magnetic plain plate 400, which comprises a square plain plate body 410 with 4 corners and a plurality of second magnetic beads 420. The plain plate body 410 is an integrally formed square frame and has a hollow structure, that is, the middle thereof is hollow. The side length of the plain plate body 410 is the same as that of the cube body 110. The sizes of the second magnetic beads 420 and the first magnetic beads 120 may be the same or different. Preferably, the sizes of the second magnetic beads 420 and the first magnetic beads 120 are the same.

The square plain plate body 410 has four inner sides and each inner side has the second engaging structure, which has the third slot 411 and two third protrusions 412. The second engaging structure is arranged at the middle position of each inner side of the square plain plate body 410, and the third slot 411 is arranged between the two third protrusions 412, wherein the width and height of the third slot 411 are the same as those of the two third protrusions 412. Preferably, the height of the plain plate body 410 is the height of the third slot 411 or the height of the two third protrusions 412. Preferably, the second engaging structure has a same structure with the first engaging structure, that is, the third slot 411 has the same length, width and height as those of the first slot 1113, and the two third protrusions 412 have the same length, width and height as those of the two first protrusions 1114.

Alternatively, on each side of the plain plate body 410, the fourth slot 413 is provided between each of the two third protrusions 412 and each top corner of the plain plate body 410, that is, each side of the plain plate body 410 is provided with two fourth slots 413. The weight of the magnetic plain plate 400 can be reduced by setting the fourth slot 413.

The third slot 411 of the second engaging structure is matched with the connector 212 of the track component 210, and the connector 212 can be installed in the third slot 411 in a snap-fit manner, so that the track 200 can be fixed with the second engaging structure of the magnetic plain plate 400 in a snap-fit manner.

Alternatively, the plain plate body 410 is made of PVC material, PE material or ABS material, preferably ABS material.

Alternatively, the plain plate body 410 may be transparent or opaque, preferably transparent.

Alternatively, the plain plate body 410 may be of different colors, comprising red, green, blue, orange, yellow, cyan, purple, black and white.

The interior of four top corners of the plain plate body 410 comprises a small cube space for placing the second magnetic bead 420. Alternatively, 4 second magnetic beads 120 are provided, that is, each of the four top corners of the plain plate body 410 is provided with one second magnetic bead 420.

When two magnetic plain plates 400 are close to each other, the magnetic attraction between the second magnetic beads 420 splices the two magnetic plain plates 400 together, so that different shapes can be realized by arbitrarily splicing the magnetic plain plates 400. Similarly, when a magnetic plain plate 400 and a magnetic cube 100 are close to each other, the magnetic attraction between the second magnetic beads 420 and the first magnetic beads 120 splices the magnetic plain plate 400 and the magnetic cube 100 together, so that the magnetic plain plates 400 and the magnetic cubes 100 can be arbitrarily combined into different shapes through magnetic splicing.

Figure 19:
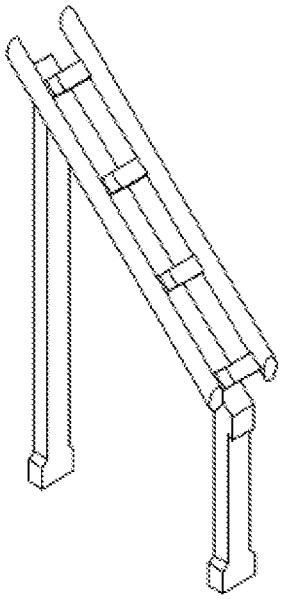
FIG. 19 is a perspective view of a down-extender inclined straight track component provided by the second embodiment of the present application.
Figure 20:
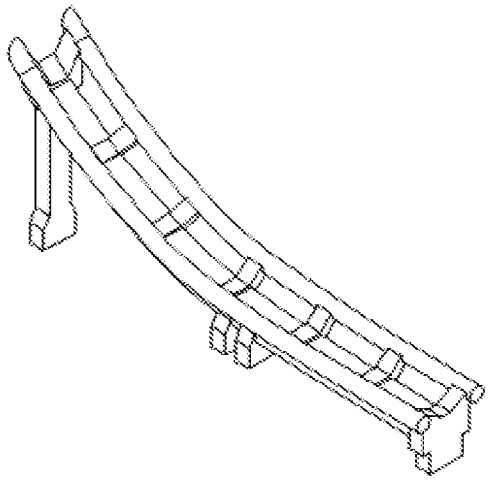
FIG. 20 is a perspective view of a bottom-hill track component provided by the second embodiment of the present application.
Figure 21:
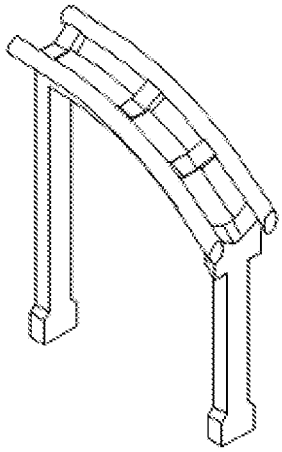
FIG. 21 is a perspective view of a top-hill track component provided by the second embodiment of the present application.
Figure 22:
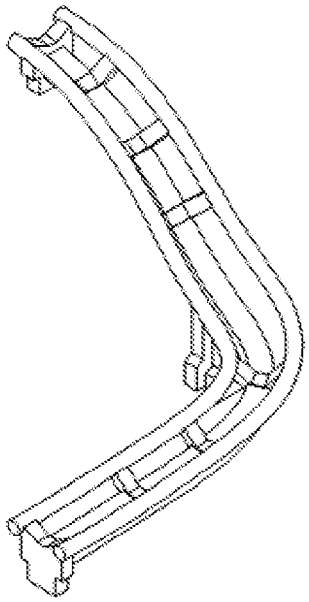
FIG. 22 is a perspective view of a down-turn track component provided by the second embodiment of the present application.

Referring to FIGS. 18 to 22, FIG. 18 is a perspective view of a loop track component, FIG. 19 is a perspective view of a down-extender inclined straight track component, FIG. 20 is a perspective view of a bottom-hill track component, FIG. 21 is a perspective view of a top-hill track component, and FIG. 22 is a perspective view of a down-turn track component.

The magnetic cube roller coaster provided by the second embodiment of the present application is also different from the first embodiment in that: the track 200 further comprises a loop track component, a down-extender inclined straight track component, a bottom-hill track component, a top-hill track component and a down-turn track component. Theses track components are more complex in shape and occupy more space, so they cannot be all fixed in the magnetic cubes 100 in a snap-fit manner, and need to be partially or fully fixed in the magnetic plain plates 400 in a snap-fit manner.

Compared with the first embodiment, the shape of the track 200 may have more changes and is more complex, which requires the user to use his brain and think more. According to the different shapes of the track components, one part of the track components are fixed in the magnetic cubes 100 in a snap-fit manner, and the other part of the track components are fixed on the magnetic plain plates 400 in a snap-fit manner. Therefore, the magnetic cube roller coaster provided by the second embodiment increases the difficulty of assembling the magnetic cube roller coaster and the fun of playing with it, and also improves the educational function.

Figure 23:
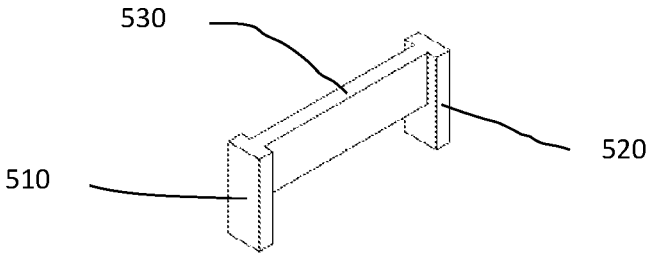
FIG. 23 is a perspective view of a magnetic launcher provided by the second embodiment of the present application.

Further, FIG. 23 is a perspective view of a magnetic launcher. The magnetic cube roller coaster provided by the second embodiment of the present application further comprises a magnetic launcher 500. The magnetic launcher 500 has a structure with a cross section of "I" shape, comprising a left baffle 510, a right baffle 520 and a panel 530 between the left baffle 510 and the right baffle 520 and connecting the left baffle 510 and the right baffle 520. The left baffle 510 has the same structure as that of the right baffle 520, and may be fixed in the first slot 1113 of the magnetic cube 100 or the third slot 411 of the magnetic plain plate 400 in a snap-fit manner. The length of the panel 530 is the same as the side length of the magnetic cube 100, so that the magnetic launcher 500 can be installed on the magnetic cube 100 or the magnetic plain plate 400, and the height of the panel 530 is less than the height of the left baffle 510 or the right baffle 520, the top of the panel 530 is flush with the top of the left baffle 510 and the right baffle 520, and the bottom of the panel 530 is at a certain distance from the bottom of the left baffle 510 and the right baffle 520, so that the panel 530 is located above the track 200 and can contact with the steel ball 300, so as to prevent the steel ball 300 from advancing forward.

Figure 24:
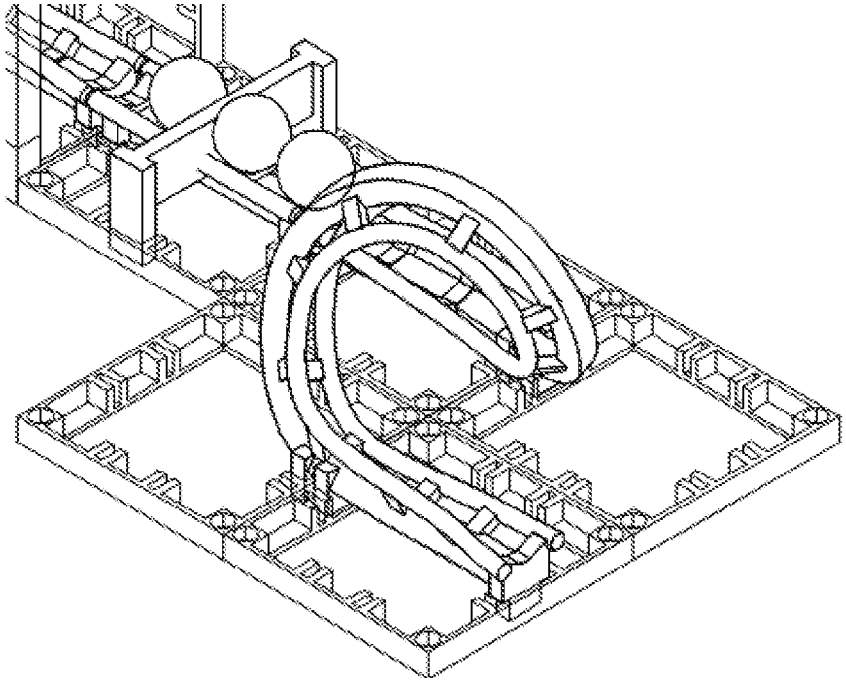
FIG. 24 is a partial enlarged view of the magnetic cube roller coaster shown in FIG. 15.

When in use, with reference to FIG. 24, the magnetic launcher 500 can be arranged at or near the end of the track 200 to prevent the steel ball 300 from moving forward, so as to prevent the steel ball 300 from flying out of the track 200 and accidentally injuring people nearby or flying too far to be found.

The other structure of the magnetic cube roller coaster provided by the second embodiment of the application is the same as that of the first embodiment, which will not be described here.

The embodiments of the present application have been described in detail above, specific embodiments are used in this document to explain the principles and implementation of the present application, the descriptions of the above embodiments are only used to help understand the method and core ideas of the present application; at the same time, persons of ordinary skill in the art may change the specific implementation and application scope according to the idea of the present application, in summary, the content of the present description should not be construed as a limitation on the present application.

What is claimed is:

1. A magnetic cube, comprising a cube body with hollow structure, wherein the cube body comprises four identical U-shaped frames, each of the four U-shaped frames has two rectangular corners and two free ends, wherein an insert socket is arranged at each of the two rectangular corners and perpendicular to the two free ends, each of the two free ends is provided with an insert connection which is insertable into the insert socket of another one of the four U-shaped frames, each of the two rectangular corners has a first magnetic bead inside, at least one first engaging structure is arranged on each inner side of each of the four U-shaped frames, the first engaging structure has a first slot and two first protrusions, the first slot is formed between the two first protrusions.

2. The magnetic cube of claim 1, wherein the magnetic cube further comprises a fixing clip, which is clamped with two neighboring magnetic cubes simultaneously, and the fixing clip comprises a flat plate and two plug slots, wherein each of the two plug slots is configured to be stuck in the first slot.

3. A magnetic cube roller coaster, comprising a track, a steel ball and the magnetic cube of claim 1, the track is fixed with the first engaging structure of the magnetic cube in a snap-fit manner, the track comprises a plurality of track components with different shapes, wherein each of the track components comprises a contact surface and a connector located below the contact surface and integrally formed with the contact surface.

4. The magnetic cube roller coaster of claim 3, wherein the track comprises a horizontal forward straight track component, a horizontal 180-degree turn track component, a down forward track component and a horizontal 90-degree turn track component.

5. The magnetic cube roller coaster of claim 3, wherein the magnetic cube roller coaster further comprises a magnetic plain plate which has a square plain plate body with four corners and four second magnetic beads arranged therein, the square plain plate body has a hollow structure, the square plain plate body has four inner sides and each inner side has a second engaging structure with a first slot and two first protrusions, the first slot is formed between the two first protrusions, the magnetic plain plate and the magnetic cube are combined into different shapes through magnetic splicing.

6. The magnetic cube roller coaster of claim 5, wherein the track is fixed with the second engaging structure of the magnetic plain plate in a snap-fit manner, and the second engaging structure has a same structure with the first engaging structure.

7. The magnetic cube roller coaster of claim 6, wherein the track further comprises a loop track component, a down-extender inclined straight track component, a bottom-hill track component, a top-hill track component and a down-turn track component.

8. The magnetic cube roller coaster of claim 5, wherein the magnetic cube roller coaster further comprises a magnetic launcher for preventing the steel ball from moving forward, the magnetic launcher has a structure with a cross section of "I" shape, the magnetic launcher is fixed in the magnetic cube or on the magnetic plain plate in a snap-fit manner.

* * * * *